US006321952B1

(12) United States Patent
Cassier et al.

(10) Patent No.: US 6,321,952 B1
(45) Date of Patent: Nov. 27, 2001

(54) SPRAYER ACTUATING DEVICE

(75) Inventors: Didier Cassier; Brigitte Illel; Henry Saunal, all of Montpellier (FR)

(73) Assignee: Sanofiosynthelabo, Paris (FR)

( * ) Notice: Subject to any disclaimer, the term of this patent is extended or adjusted under 35 U.S.C. 154(b) by 0 days.

(21) Appl. No.: 09/601,052

(22) PCT Filed: Jan. 22, 1999

(86) PCT No.: PCT/FR99/00124

§ 371 Date: Nov. 3, 2000

§ 102(e) Date: Nov. 3, 2000

(87) PCT Pub. No.: WO99/38620

PCT Pub. Date: Aug. 5, 1999

(30) Foreign Application Priority Data

Jan. 30, 1998 (FR) ..... 98 01093

(51) Int. Cl.[7] ..... B67D 3/00

(52) U.S. Cl. ..... 222/505; 222/321.7; 222/321.9

(58) Field of Search ..... 222/287, 309, 222/321.7, 321.9, 509, 515, 516, 505

(56) References Cited

U.S. PATENT DOCUMENTS 2,136,940 * 11/1938 Ehbrecht ..... 299/95
2,815,885 * 12/1957 Haas ..... 222/82
3,150,800 * 9/1964 Weber III ..... 222/70
3,162,335 * 12/1964 Kogan et al. ..... 222/212
3,858,762 * 1/1975 Meshberg ..... 222/180
4,033,487 * 7/1977 Micallef ..... 222/207
4,069,949 * 1/1978 Ryckman, Jr. ..... 222/146 HA
4,789,083 * 12/1988 Gutierrez ..... 222/108
5,152,425 * 10/1992 Baudin ..... 222/1

* cited by examiner

*Primary Examiner*—Kevin Shaver
*Assistant Examiner*—Frederick C Nicolas
(74) *Attorney, Agent, or Firm*—Michael D. Alexander

(57) ABSTRACT

The invention concerns a sprayer (12) actuating device comprising a support (22) whereon the sprayer (12) is supported and a member (24) actuating the sprayer knob (18) mobile axially relative to the support by action of the control means (34, 36, 43, 46, 47, 58) between a position driving in the knob (18) and a position releasing it, the control means (34, 36, 43, 47, 58) comprising elastic means (36) for urging the actuating member in depressing position and means capable of disengaging (58) the lock of the actuating member into releasing position. The control means comprise a rotatable handle (43) manually actuated by a user and associated to a cam (43) moving the actuating member (24) from the depressing position to the releasing position.

31 Claims, 2 Drawing Sheets

SPRAYER ACTUATING DEVICE

The present invention relates to a device for actuating a sprayer, particularly suited to actuating a sprayer equipped with a manual pump.

As is conventional, this type of pump comprises a push-button on which pressure has to be exerted manually in order to deliver a dose of product.

As each action on the push-button is performed manually, both the effort exerted and the time for which the effort is exerted cannot be reproduced perfectly from one spraying operation to the next, which means that the doses thus delivered are not all identical.

In certain applications, particularly in the field of pharmacology, in which applications it is necessary to obtain perfectly reproducible doses, that is to say doses containing the same amount of active principle and which produce the same dispersion of droplets after delivery, it is known practice for the sprayer to be fitted with an attached actuating device of the type comprising a support against which the sprayer is intended to rest and a member for actuating the push-button which can be moved axially with respect to the support under the action of manoeuvring means between a position in which the push-button is depressed and a position in which it is released, the manoeuvring means comprising elastic means for urging the actuating member into the position for depressing the push-button, and disengagable means for locking the actuating member in the position for releasing this button.

In this type of device, the action exerted on the push-button of the sprayer is provided by a mechanical member, which makes it possible to obtain an actuating force and duration which can be perfectly reproduced and therefore makes it possible to supply identical doses of product.

However, the actuating device is armed manually by a translational movement by exerting effort both on the support and on the manoeuvring means, against the action of the elastic means.

Thus, this type of device exhibits a certain number of drawbacks, particularly on account of the fact that arming it requires the user to exert a relatively large amount of physical effort to counter the effort provided by the spring.

Furthermore, the user naturally, in order to exert this effort, tends to position the device and the sprayer it contains horizontally, and this tends to give rise to malfunctioning in the sprayer.

The object of the invention is to alleviate these drawbacks.

The subject of the invention is therefore a device for actuating a sprayer of the aforementioned type, characterized in that the manoeuvring means comprise a rotary knob which can be actuated manually by a user and which is associated with a cam designed to cause the actuating member to move from the position in which the push-button is depressed to the position in which this button is released.

Thus, as the device can be armed by rotating the knob, the travel of the manoeuvring member from its position in which the push-button is depressed to its position in which this button is released, is longer than was the case in actuating devices that employed arming through a translational movement, thus accordingly reducing the effort that needs to be exerted in order to counter the effort applied by the spring.

Furthermore, in order to perform this movement, the user naturally tends to hold the device and the sprayer in the vertical position. This thus avoids the occurrence of malfunctioning with the sprayer.

The actuating device according to the invention may further comprise one or more of the following features, taken in isolation or in any technically feasible combination:

- the cam consists of a roughly cylindrical part secured to the knob and equipped with an end edge delimiting a guiding surface for at least one follower borne by the actuating member, the end edge comprising at least one elemental saw-tooth pattern;
- the member for actuating the push-button comprises a stem equipped with a proximal end resting against the push-button and a distal end coaxial with the cam and equipped with arms extending radially and each carrying a follower;
- the means for locking the actuating member in the position of releasing the push-button comprise a locking piece which can be moved radially between a radially internal active position for immobilizing the stem and in which it forms a stop against which a complementary bearing surface of the stem abuts and a radially external inactive position of freeing the stem, and an elastic member for urging the said piece into the active position;
- the stem has a flat extending axially between the distal end and the bearing surface, against which flat a complementary lateral flat surface of the locking piece rests as the stem moves;
- the knob pivots about a cylindrical guide through which the stem for actuating the push-button passes, with the interposition of one-way running elements;
- the support comprises at least one front opening for the passage of a dose of product, and the proximal end of the stem has a head equipped with an axial slot in which a nozzle with which the push-button is equipped for dispensing the product is engaged;
- the support has an attached removable bottom against which the body of the sprayer rests;
- the device further comprises a fold-down arm articulated to the support and intended, in the deployed position, to rest against a surface that is to be sprayed, so that the sprayer can be positioned with respect to this surface.

Other features and advantages will become apparent from the following description which is given merely by way of example and made with reference to the appended drawings, in which:

FIG. 1 depicts a front view of a device 10 for actuating a sprayer 12 according to the invention.

Figure 1:
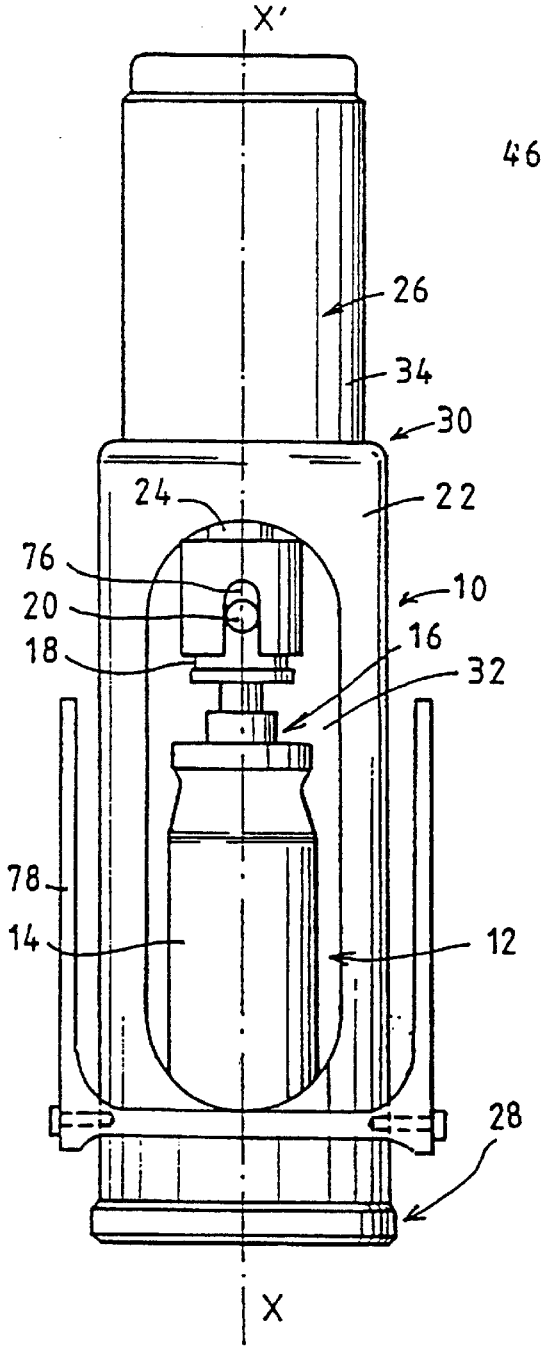
FIG. 1 is an overall view of a sprayer equipped with an actuating device according to the invention.

It has a plane of symmetry X–X', assumed to be vertical.

The sprayer 12 is a sprayer of the conventional type and will therefore not be described in detail.

It will be observed that it comprises a body 14 for storing a product away from the air and equipped with a pump 16 itself provided with a push-button 18 comprising a nozzle 20 to allow a dose of product to be delivered.

Figure 2:
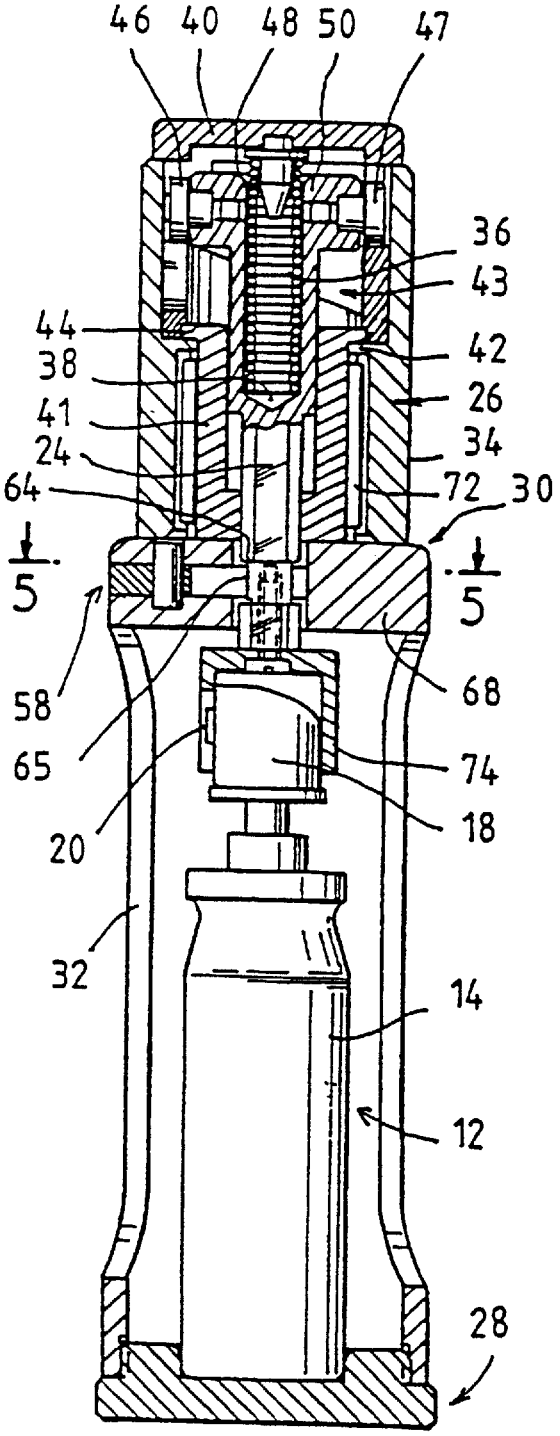
FIG. 2 is a view in longitudinal section of the actuating device of FIG. 1, in the armed position.
Figure 3:
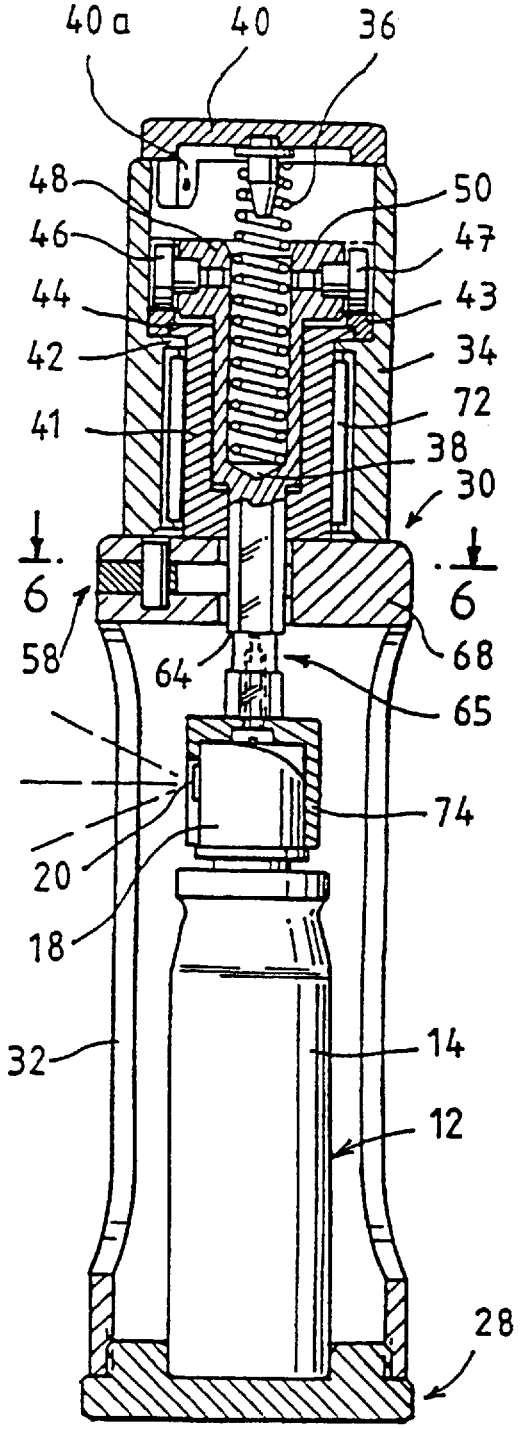
FIG. 3 is a view in longitudinal section of the actuating device of FIG. 1, in the position in which the push-button is depressed.

Referring also to FIGS. 2 and 3, the device 10 comprises: a hollow body 22 made of a material appropriate to the envisaged use, for example a plastic, accommodating the sprayer 12; a member 24 for actuating the push-button 18 and means 26 for manoeuvring the actuating member 24 to allow the latter to be moved between an armed position in which the push-button 18 is released and which is illustrated in FIG. 2, and a position in which this button is depressed, and represented in FIG. 3.

The hollow body 22 comprises a lower and proximal end 28 consisting of an attached bottom piece fixed, for example, by screwing, allowing access to the inside of the body 22, and an upper and distal end 30 bearing the actuating member 24 and the means 26 of manoeuvring the latter.

The hollow body 22 comprises a front opening 32 placed facing the nozzle 20 and of appropriate dimensions to be consistent with the solid angle with which a spray of product is atomized.

Referring now to FIGS. 2 and 3, which depict the device 10 in the position in which the push-button is released and in the position in which the latter is depressed, respectively, it can be seen that the actuating member consists of a stem 24 extending through the hollow body 22, coaxially therewith.

The stem 24 is mounted so that it can be moved axially in the body 22 between a first, high, retracted position in which the push-button 18 is released (FIG. 2) and a second, low position in which this button is depressed (FIG. 3), under the command of the manoeuvring means 26, in a first, down, stroke for dispensing product and a second, up, stroke for arming the device 10.

The means for manoeuvring the stem 24 comprise a knob 34 of cylindrical overall shape mounted so that it can rotate on the upper end 30 of the body 22, and an elastically deformable member 36 consisting of a spring equipped with a first lower end engaged in a complementary housing 38 formed in the stem 24 and resting against the bottom thereof and an opposite, upper end, resting against a cap 40 secured to the knob 34, so as to urge the stem 24 into the position for depressing the push-button (FIG. 3).

More specifically, the knob 34 is mounted so that it can rotate about a guide 41 of cylindrical overall shape through which the stem 24 passes, this guide being itself fixed by screwing onto the upper end 30 of the body 22.

The cap 40 has attachment tabs, such as 40*a*, for attaching it to the knob 34.

The knob 34 has an internal annular shoulder 42 delimiting a bore in which is mounted a cam 43 designed to cause the stem 24 to move from the position for depressing the push-button 18, into the position of releasing it, as the knob 34 is turned.

Furthermore, the internal shoulder 42 of the knob 34 also constitutes a seat against which there rests an annular end rim 44 formed on the upper end of the guide 41 for attaching the knob to the body 22.

The cam 43 consists of a roughly cylindrical part fixed by screwing to the knob 34 and having an upper end edge delimiting a guiding surface along which two followers 46 and 47 travel, these followers each being borne by a transverse arm 48 and 50, respectively, borne by the upper end of the stem 24.

Figure 4:
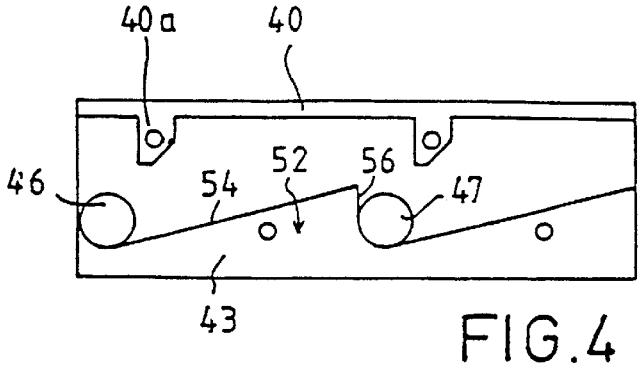
FIG. 4 is a development of the cam of the device of FIGS. 1 to 3.

As can be seen in FIG. 4, the upper end edge of the cam 43 comprises a succession of elemental saw-tooth patterns, such as 52, comprising an inclined leading edge 54 which, as the knob 34 is turned, causes the stem 24 to move in the arming stroke, and a roughly vertical falling edge 56 corresponding to the movement of the stem 24 during the product-dispensing stroke.

As can be seen in this FIG. 4, the cam 43 has, for example, two elemental patterns 52. In consequence, the movement of the stem 24 from the position in which the push-button 18 is depressed into the position in which the latter is released will occur in an angular travel of the knob 34 through 180°.

It is, however, possible to give the cam 43 any number of such patterns depending on the demultiplication to be obtained to counter the effort exerted by the spring 36 for moving the stem 24 and arming the device.

Thus, for example, to reduce the effort to be applied to manoeuvre the knob 34 still further, the use of a single pattern will entail an angular movement through 360°. This then doubles the knob travel needed to arm the device.

It can finally be seen from FIGS. 2 and 3 that the device is supplemented by a member 58 for automatically locking the stem 24 in the up position in which the device is armed.

Figure 5:
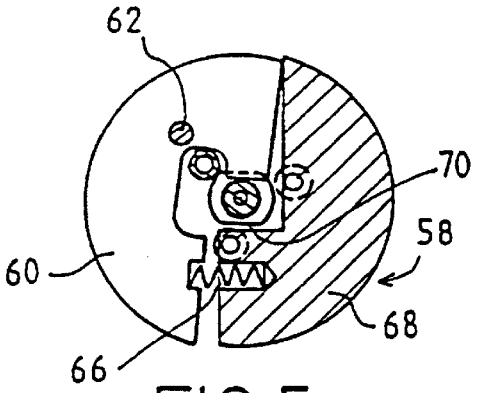
FIG. 5 is a view in section on the line 5—5 of the device of FIG. 2, showing the piece for immobilizing the stem.
Figure 6:
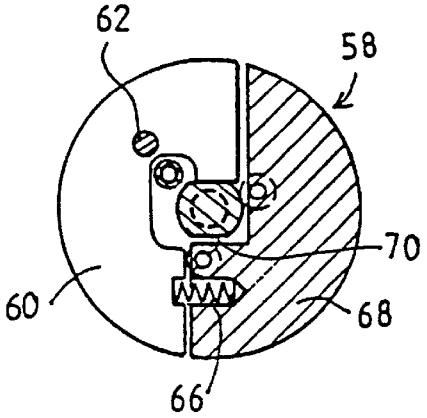
FIG. 6 is a view in section on the line 6—6 of FIG. 3.

As can be seen in FIGS. 5 and 6, this locking member comprises a locking piece 60 mounted so that it can pivot in a radial direction about a spindle 62 borne by the upper end 30 of the body 22 between a radially internal active position for immobilizing the stem 24 (FIG. 5) and in which it forms a stop against which a bearing surface 64 of the stem 24, consisting of the upper edge of an annular groove 65 formed near the proximal end of the stem 24 rests, and a radially external inactive position of freeing the stem.

As can be seen in these FIGS. 5 and 6, the locking means 58 further comprise an elastic member 66 equipped with a first end engaged in a housing formed in an axial continuation 68 of the body 22 and an opposite end bearing against the locking piece 60, in a region which is offset with respect to the rotation spindle 62, so as to urge this piece 60 into the active position.

Furthermore, the stem 24 has two mutually opposed flats such as 70, collaborating with two complementary surfaces formed, in the case of one of them, on the locking piece 60 and, in the case of the other, on the continuation 68 of the body 22 so as to prevent the stem 24 from turning as it moves between the positions in which the push-button 18 is depressed and the one in which it is released.

It will finally be noted that, between the cylindrical guide 41 and the knob 34 there are some one-way running elements such as 72, of a conventional type, which allow the knob 34 to move angularly in just one direction of rotation, so as to prevent the inadvertent expelling of a fraction of a dose if the device is not fully armed.

It will finally be noted that the lower end of the stem 24 is equipped with a head 74 shaped in such a way as to fit onto the push-button 18 through the fact that their shapes complement each other.

The head 74 has an axial slot 76 in which the nozzle 20 is engaged (FIG. 1), so as to prevent the nozzle from being in a different angular position from the opening 32.

The device which has just been described is used as follows.

First of all, the sprayer 12 is introduced into the body 22 from the bottom 28 in such a way that the push-button 18 with which it is equipped fits into the head 74.

Once the bottom 28 has been put back in place, it will be considered hereinafter, for describing the phase of arming the device, that the latter is in the position illustrated in FIG. 3.

In order to take a dose of product, the user manually actuates the knob 34 to turn it through an angle of about 180°.

During this movement, the followers 46 and 47 run along the rising portion 54 of the cam 43, which causes the stem 24 to move upwards.

It will be noted that during this movement, the locking piece 60 and the continuation 68 of the body 22 rest against the flats 70 of the stem in such a way as to prevent any angular movement thereof.

At the end of the travel of the stem 24, as depicted in FIG. 2, the locking piece 58 clips into the groove 64 formed in the stem so that the latter is locked in the position in which the push-button is released and the device is armed.

When there is a desire to take a dose of product, pressure is exerted on the locking piece 60 in order to disengage it from the groove 65. The stem thus released depresses the push-button 18 under the action of the spring 36, and this causes a dose of product to be expelled (FIG. 3).

The invention just described, using the effort exerted by a spring to actuate a push-button of a pump makes it possible to obtain perfectly reproducible doses of product.

Furthermore, as the device is armed by a rotational movement, the force to be exerted on the knob 34 is considerably lower.

It will finally be appreciated that since the means implemented to arm the device are arranged on the top of the latter, the effort needed for arming is independent of the mass of the sprayer.

The description of the invention which has just been described is not restricted to the embodiment described.

Specifically, it is possible, as can be seen in FIG. 1, for the device to be fitted with one or more fold-down arms 74, articulated to the body 22 and intended, in the deployed position, to rest against the surface that is to be treated, so as to constitute means of gauging the distance, so as to reproducibly position the sprayer with respect to this surface.

This then yields a perfectly metered dose of product delivered onto a perfectly defined surface that is to be treated.

What is claimed is:

1. A device for actuating a sprayer (12) comprising a body (14) for storing a product away from the air and a push-button (18) for dispensing the product, the device comprising a support (22) against which the sprayer (12) is intended to rest, a member (24) for actuating the push-button (18) which an be moved axially with respect to the support (22) under the action of maneuvering means (34, 36, 43, 46, 47, 58) between a position in which the push-button (18) is depressed and a position in which it is released, the maneuvering means comprising a rotary knob (34) which can be actuated manually by a user and which is associated with a cam (43) designed to cause the actuating member (24) to move from the position in which the push-button (18) is depressed into the position in which this button is released, wherein the maneuvering means comprise elastic means (36) for urging the actuating member (24) into the position for depressing the push-button and disengagable means (58) for locking the actuating member (24) in the position for releasing this push-button (18), and in that the cam (43) consists of a roughly cylindrical part secured to the knob (34) and equipped with an end edge delimiting a guiding surface for at least one follower (46, 47) borne by the actuating member (24), the end edge comprising at least one elemental saw-tooth pattern (52).

2. A device according to claim 1 wherein the member for actuating the push-button comprises a stem (24) equipped with a proximal end resting against the push-button (18) and a distal end coaxial with the cam (43) and equipped with arms (48, 50) extending radially and each carrying a follower (46, 47).

3. A device according to claim 1 wherein the support (22) comprises at least one front opening (32) for the passage of a dose of product, in that the proximal end of the stem has a head (74) equipped with an axial slot (76) in which a nozzle (20) with which the push-button (18) is equipped for dispensing the product is engaged.

4. A device according to claim 1 wherein the support (22) has an attached removable bottom (28) against which the body (14) of the sprayer rests.

5. A device according to claim 1 wherein it further comprises a fold-down arm (78) articulated to the support (22) and intended, in the deployed position, to rest against a surface that is to be sprayed, so that the sprayer (12) can be positioned with respect to this surface.

6. A device according to claim 2 wherein the means (58) for locking the actuating member (24) in the position of releasing the push-button (18) comprise a locking piece (60) which can be moved radially between a radially internal active position for immobilizing the stem (24) and in which it forms a stop against which a complementary bearing surface (64) of the stem (24) abuts and a radially external inactive position of freeing the stem (24), and an elastic member (66) for urging the said piece (60) into the active position.

7. A device according to claim 2 wherein the knob (34) pivots about a cylindrical guide (41) through which the stem (24) for actuating the push-button (18) passes, with the interposition of one-way running elements (72).

8. A device according to claim 2 wherein the support (22) comprises at least one front opening (32) for the passage of a dose of product, in that the proximal end of the stem has a head (74) equipped with an axial slot (76) in which a nozzle (20) with which the push-button (18) is equipped for dispensing the product is engaged.

9. A device according to claim 2 wherein the support (22) has an attached removable bottom (28) against which the body (14) of the sprayer rests.

10. A device according to claim 2 wherein it further comprises a fold-down arm (78) articulated to the support (22) and intended, in the deployed position, to rest against a surface that is to be sprayed, so that the sprayer (12) can be positioned with respect to this surface.

11. A device according to claim 3 wherein the support (22) has an attached removable bottom (28) against which the body (14) of the sprayer rests.

12. A device according to claim 3 wherein it further comprises a fold-down arm (78) articulated to the support (22) and intended, in the deployed position, to rest against a surface that is to be sprayed, so that the sprayer (12) can be positioned with respect to this surface.

13. A device according to claim 4 wherein it further comprises a fold-down arm (78) articulated to the support (22) and intended, in the deployed position, to rest against a surface that is to be sprayed, so that the sprayer (12) can be positioned with respect to this surface.

14. A device according to claim 6 wherein the stem (24) has a flat (70) extending axially between the distal end and the bearing surface, against which flat a complementary lateral flat surface of the locking piece rests as the stem (24) moves.

15. A device according to claim 6 wherein the knob (34) pivots about a cylindrical guide (41) through which the stem (24) for actuating the push-button (18) passes, with the interposition of one-way running elements (72).

16. A device according to claim 6 wherein the support (22) comprises at least one front opening (32) for the passage of a dose of product, in that the proximal end of the stem has a head (74) equipped with an axial slot (76) in which a nozzle (20) with which the push-button (18) is equipped for dispensing the product is engaged.

17. A device according to claim 6 wherein the support (22) has an attached removable bottom (28) against which the body (14) of the sprayer rests.

18. A device according to claim 6 wherein it further comprises a fold-down arm (78) articulated to the support (22) and intended, in the deployed position, to rest against a surface that is to be sprayed, so that the sprayer (12) can be positioned with respect to this surface.

19. A device according to claim 7 wherein the support (22) comprises at least one front opening (32) for the passage of a dose of product, in that the proximal end of the stem has a head (74) equipped with an axial slot (76) in which a nozzle (20) with which the push-button (18) is equipped for dispensing the product is engaged.

20. A device according to claim 7 wherein the support (22) has an attached removable bottom (28) against which the body (14) of the sprayer rests.

21. A device according to claim 7 wherein it further comprises a fold-down arm (78) articulated to the support (22) and intended, in the deployed position, to rest against a surface that is to be sprayed, so that the sprayer (12) can be positioned with respect to this surface.

22. A device according to claim 14 wherein the knob (34) pivots about a cylindrical guide (41) through which the stem (24) for actuating the push-button (18) passes, with the interposition of one-way running elements (72).

23. A device according to claim 14 wherein the support (22) comprises at least one front opening (32) for the passage of a dose of product, in that the proximal end of the stem has a head (74) equipped with an axial slot (76) in which a nozzle (20) with which the push-button (18) is equipped for dispensing the product is engaged.

24. A device according to claim 14 wherein the support (22) has an attached removable bottom (28) against which the body (14) of the sprayer rests.

25. A device according to claim 14 wherein it further comprises a fold-down arm (78) articulated to the support (22) and intended, in the deployed position, to rest against a surface that is to be sprayed, so that the sprayer (12) can be positioned with respect to this surface.

26. A device according to claim 15 wherein the support (22) comprises at least one front opening (32) for the passage of a dose of product, in that the proximal end of the stem has a head (74) equipped with an axial slot (76) in which a nozzle (20) with which the push-button (18) is equipped for dispensing the product is engaged.

27. A device according to claim 15 wherein the support (22) has an attached removable bottom (28) against which the body (14) of the sprayer rests.

28. A device according to claim 15 wherein it further comprises a fold-down arm (78) articulated to the support (22) and intended, in the deployed position, to rest against a surface that is to be sprayed, so that the sprayer (12) can be positioned with respect to this surface.

29. A device according to claim 22 wherein the support (22) comprises at least one front opening (32) for the passage of a dose of product, in that the proximal end of the stem has a head (74) equipped with an axial slot (76) in which a nozzle (20) with which the push-button (18) is equipped for dispensing the product is engaged.

30. A device according to claim 22 wherein the support (22) has an attached removable bottom (28) against which the body (14) of the sprayer rests.

31. A device according to claim 22 wherein it further comprises a fold-down arm (78) articulated to the support (22) and intended, in the deployed position, to rest against a surface that is to be sprayed, so that the sprayer (12) can be positioned with respect to this surface.

* * * * *